US008776563B1

(12) United States Patent
Jaffe et al.

(10) Patent No.: US 8,776,563 B1
(45) Date of Patent: Jul. 15, 2014

(54) CONCEALED HANDCUFF KEY

(75) Inventors: Joel S. Jaffe, Bellingham, WA (US); Jeffery D. Jaffe, Bellingham, WA (US); Brian Dereau, Eldrige, MO (US)

(73) Assignee: Shomer-Tec, Inc., Bellingham, WA (US)

( * ) Notice: Subject to any disclaimer, the term of this patent is extended or adjusted under 35 U.S.C. 154(b) by 6 days.

(21) Appl. No.: 13/430,350

(22) Filed: Mar. 26, 2012

(51) Int. Cl.
*A47G 29/10* (2006.01)

(52) U.S. Cl.
USPC ..... 70/456 R; 70/16; 70/402; 24/3.6; 24/429

(58) Field of Classification Search
USPC ..... 70/16, 402–404, 408, 456 R; 24/3.6, 24/429
See application file for complete search history.

(56) References Cited

U.S. PATENT DOCUMENTS 1,211,296 A * 1/1917 Davis ..... 24/102 E
2,463,815 A * 3/1949 Smith ..... 70/456 R
2,681,492 A * 6/1954 Lackritz ..... 24/416
3,144,935 A * 8/1964 Geyler ..... 70/456 R
3,224,052 A * 12/1965 Abraham ..... 70/456 R
3,267,534 A * 8/1966 Dansereau ..... 70/456 R
4,403,487 A * 9/1983 Marty ..... 70/408
4,905,878 A * 3/1990 Lovinger et al. ..... 224/163
5,083,662 A * 1/1992 Bishop et al. ..... 206/37.1
5,100,191 A * 3/1992 Detrick et al. ..... 294/3.6
5,400,480 A * 3/1995 Futch, III ..... 24/387
5,568,741 A 10/1996 Parsons
5,638,713 A * 6/1997 Roth et al. ..... 70/404
6,109,073 A 8/2000 Parsons
6,672,118 B1 * 1/2004 Wright ..... 70/459
7,520,149 B1 * 4/2009 Roemmele ..... 70/16

OTHER PUBLICATIONS

Shomer Tec—Handcuff Training Key, accessed Mar. 25, 2012 www.shomer-tec.com/product/handcuff-traiing-key-1538.cfm.

* cited by examiner

*Primary Examiner* — Christopher Boswell
(74) *Attorney, Agent, or Firm* — Dwayne E. Rogge; Schacht Law Office, Inc.

(57) ABSTRACT

Described herein are several versions of concealed handcuff keys including a key concealed within a pouch as a zipper pull, a key concealed as a common pen cap/clip, a key concealed as a coin, a key concealed as a bootlace/shoelace end, and a key concealed within a receiver in the back side of a belt buckle.

9 Claims, 15 Drawing Sheets

CONCEALED HANDCUFF KEY

BACKGROUND OF THE DISCLOSURE

Field of the Disclosure

This disclosure relates to the field of concealed handcuff keys hidden within or as common items (hidden in plain sight).

SUMMARY OF THE DISCLOSURE

Described herein are several versions of concealed handcuff keys including a key concealed within a pouch as a zipper pull, a key concealed as a common pen cap/clip, a key concealed as a coin, a key concealed as a bootlace/shoelace end, and a key concealed within a receiver in the back side of a belt buckle.

In the fields of law enforcement, and military service, being handcuffed by a malefactor is obviously dangerous. As malefactors would have reason to believe that the victim has a key to handcuffs on them, as most handcuff keys are universal, the malefactor may search the victim for such a key. Thus, it is very desirous for the victim to have on their person, one or more hidden handcuff keys, which would seem to the malefactor to be common items, and would go unnoticed. The hidden keys should be available to the victim while handcuffed.

Disclosed are several embodiment of a concealed handcuff key which is hidden as an everyday item which will normally be overlooked by an opponent during a customary search.

The handcuff key may be provided as an assembly concealed as a zipper pull. This embodiment of the concealed handcuff key assembly comprising: a handcuff key having a lock engagement end and a cord engaging end; a malleable cord attached to the cord engaging end of the handcuff key; and a housing. The housing having: an opaque outer surface; a surface defining a cord void through which the cord passes; and a surface defining a key void through which the key passes. Wherein the housing surrounds the key and conceals the key from viewing. In these embodiments, cord may be a flat strap, shoelace, cord, string, rope, webbing, or equivalents. The housing may be malleable, such as fabric, leather, rubber, plastic, or similar materials. The cord may pass twice through the cord void, and once through the cord engaging end of the key, so as to form a loop through the cord engaging end of the key such that both ends of the cord are positioned external of the housing.

The handcuff key may also be concealed as a pen cap. This embodiment may comprise: a substantially cylindrical pen cap having an inner surface configured to frictionally engage the outer surface of the writing end of a pen; and a pen cap pocket clip extending from the pen cap. The pocket clip in one form having: a first end at the pen cap, and a second end terminating in a cylinder having an outer diameter smaller than the inner diameter of a handcuff keyway, and an inner diameter larger than the outer diameter of a handcuff keyway pin. These embodiments generally have a protrusion extending from the outer diameter of the cylinder may also be provided as assembly concealed within a belt buckle, the concealed handcuff key assembly comprising: a belt buckle main body having an outer surface which is decorative and in use faces away from the wearer's body. The belt buckle main body has: an inner surface which in use faces toward the wearer's body; a belt attachment portion; a belt adjustment system. The belt buckle also has a surface defining a recess on the inner surface of the belt buckle main body which frictionally engages and holds in place the handcuff key, such that the handcuff key is hidden from view when the belt buckle is in use. To facilitate holding of the key within the receptacle, the handcuff key is comprised of a malleable material, and the recess is smaller than the handcuff key, such that the handcuff key deforms to fit within the recess.

The handcuff key may also be concealed as a pen pocket clip. The pen pocket clip comprising: a pen attachment portion; and a pocket extension protruding from the pen attachment portion. A distal end of the pocket extension in one embodiment comprises a substantially cylindrical outer surface, a substantially cylindrical outer surface, and a protrusion extending tangentially therefrom. In this embodiment, the distal end of the pen pocket clip forms a hand cuff key. In one form, the pen pocket clip is removably attached to a pen barrel.

The handcuff key may also be concealed as a coin. The coin comprising: a coin body having a first face side, a second face side, and a perimeter side; a surface defining a channel in the perimeter side; and a key extension pivotably coupled within the channel so as to selectively extend therefrom in an extended position, or a concealed position. The handcuff key of this embodiment may comprise: a first semi-cylindrical extension; a second semi-cylindrical extension; and a protrusion extending from the second semi-cylindrical extension of the cylinder which actuates an unlocking mechanism of a handcuff. In this embodiment, the key extension may not completely recess into the coin body, so that the extension may be easily accessed and manipulated when substantially recessed. While many coins are envisioned, including tokens and equivalent articles, the first face side, and second face side in one embodiment are visually similar to a US five cent piece. In one form, the key extension is pivotably coupled to the coin.

The handcuff key may also be concealed as a lace end comprising: a lace attachment portion, a handcuff unlocking portion comprising; a substantially cylindrical inner surface; a substantially cylindrical outer surface; and, a protrusion extending tangentially outward of the cylindrical outer surface.

DESCRIPTION OF THE PREFERRED EMBODIMENTS

Figure 14:
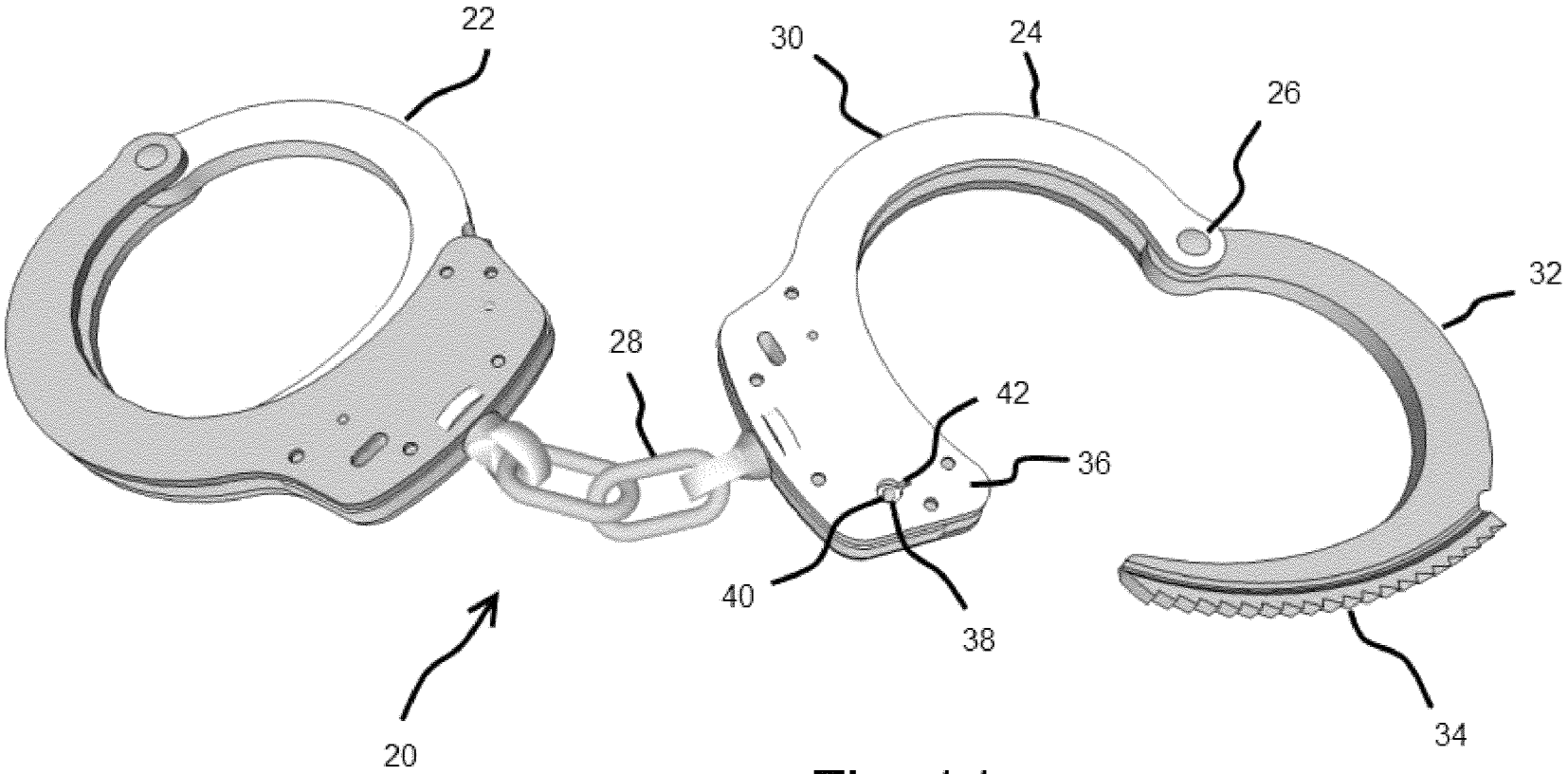
Fig. 14 Prior Art
FIG. 14 is a perspective view of one embodiment of prior art handcuffs.

Most modern handcuffs in Canada, the United States, the United Kingdom, Latin America, and elsewhere can be opened with the same standard universal handcuff key. This allows for easier transport of prisoners and keeps one out of trouble if one loses one's keys. One such handcuff 20 are shown in FIG. 14 and generally comprise a pair of bracelet-like portions 22 and 24 with a chain 28 holding the two adjacent each other. Each bracelet may be made of separate portions 30 and 32, connected by a hinge 26 or similar component. A sawtooth portion 34 may be used in conjunction with a ratcheting locking mechanism 36 used to lock the bracelet closed. To unlock the handcuff, a key is placed into the handcuff keyway 38 which is generally a cylinder-shaped surface with a rectilinear extension 42, and then rotated such that a detent on the key releases the lock and the handcuffs may be opened. To increase security, a keyway pin 40 is normally provided, which prohibits many items from being used as keys as the key must have an opening in the center thereof to receive the pin 40, must be sized to fit within the keyway 38, and must have a protrusion (flag) or equivalent to release the locking mechanism.

Figure 1:
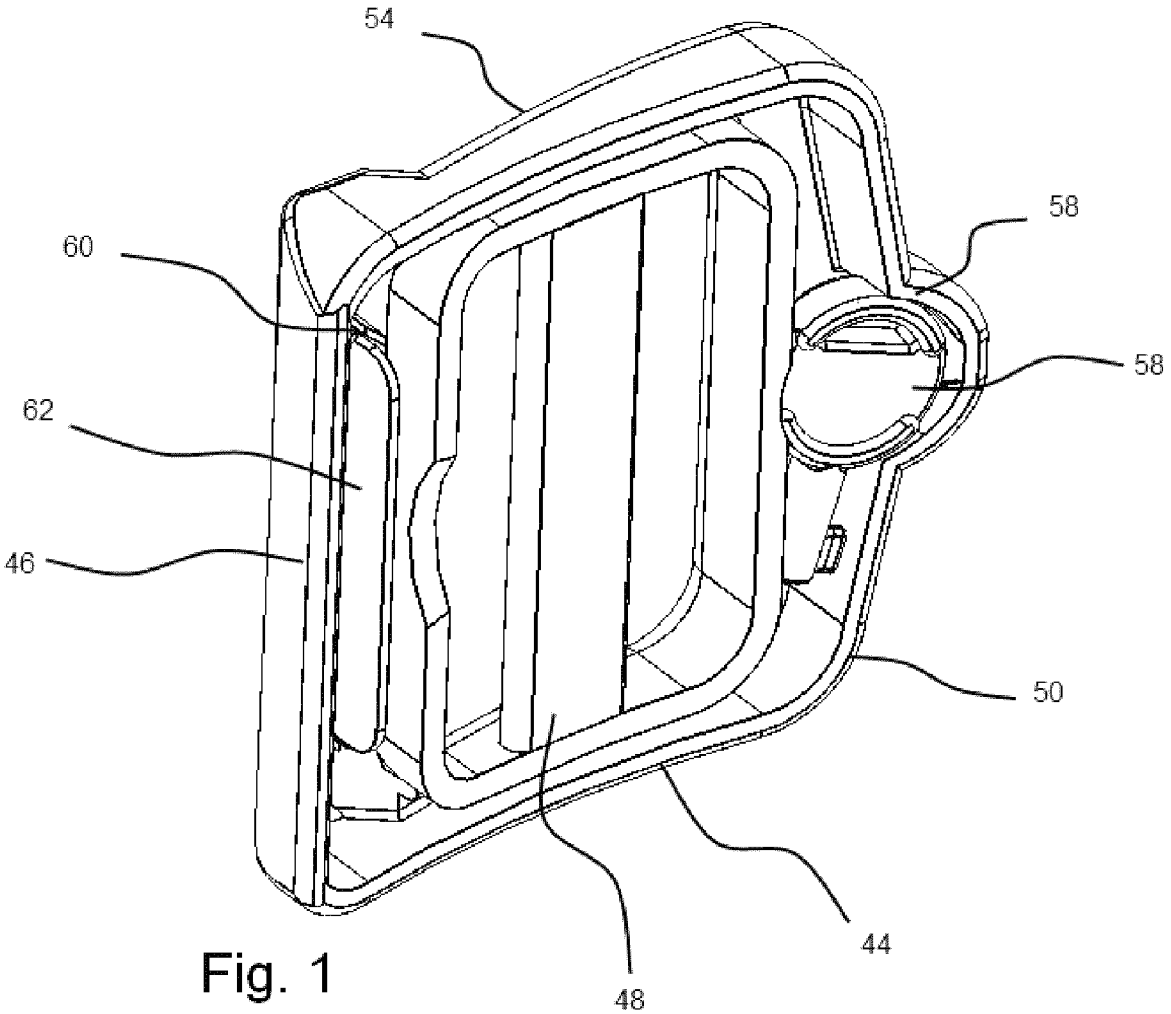
FIG. 1 is a perspective view of the back side of one embodiment of a concealed handcuff key hidden within a receptacle of a belt buckle.
Figure 1A:
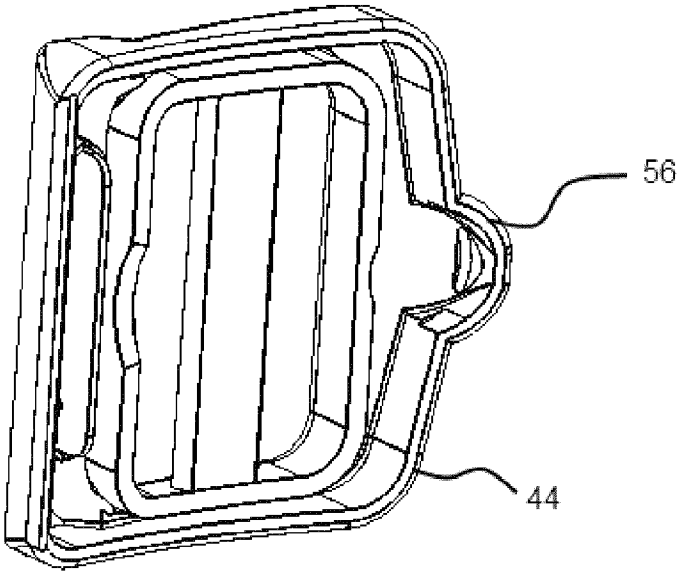
FIG. 1*a* is a perspective view of the embodiment of FIG. 1 without the handcuff key.

Looking to FIG. 1 is shown one embodiment of a belt buckle 44 from the back side, where a belt attachment bar 46 is provided for attachment to a belt, and a belt adjustment bar 48 is provided for an adjustment system to allow for adjustability of the belt relative to the wearer. Other belt attachment mechanism may be utilized. This is only one example of many.

As shown in the embodiment of FIG. 1, the main body 50 of the buckle comprises a back side 52 which normally faces the wearer, and a front side 54 which generally faces away from the user. Often, the front side 54 will include decorative designs, or materials. The back side 52 of the buckle also comprises a surface 56 forming a receptacle for a handcuff key 58. In one form, the handcuff key is made of a relatively hard, malleable material such as plastic, which slightly deforms as it is forced into the receptacle so as to frictionally engage the surface 56 and be held in place until forcefully removed.

Figure 2:
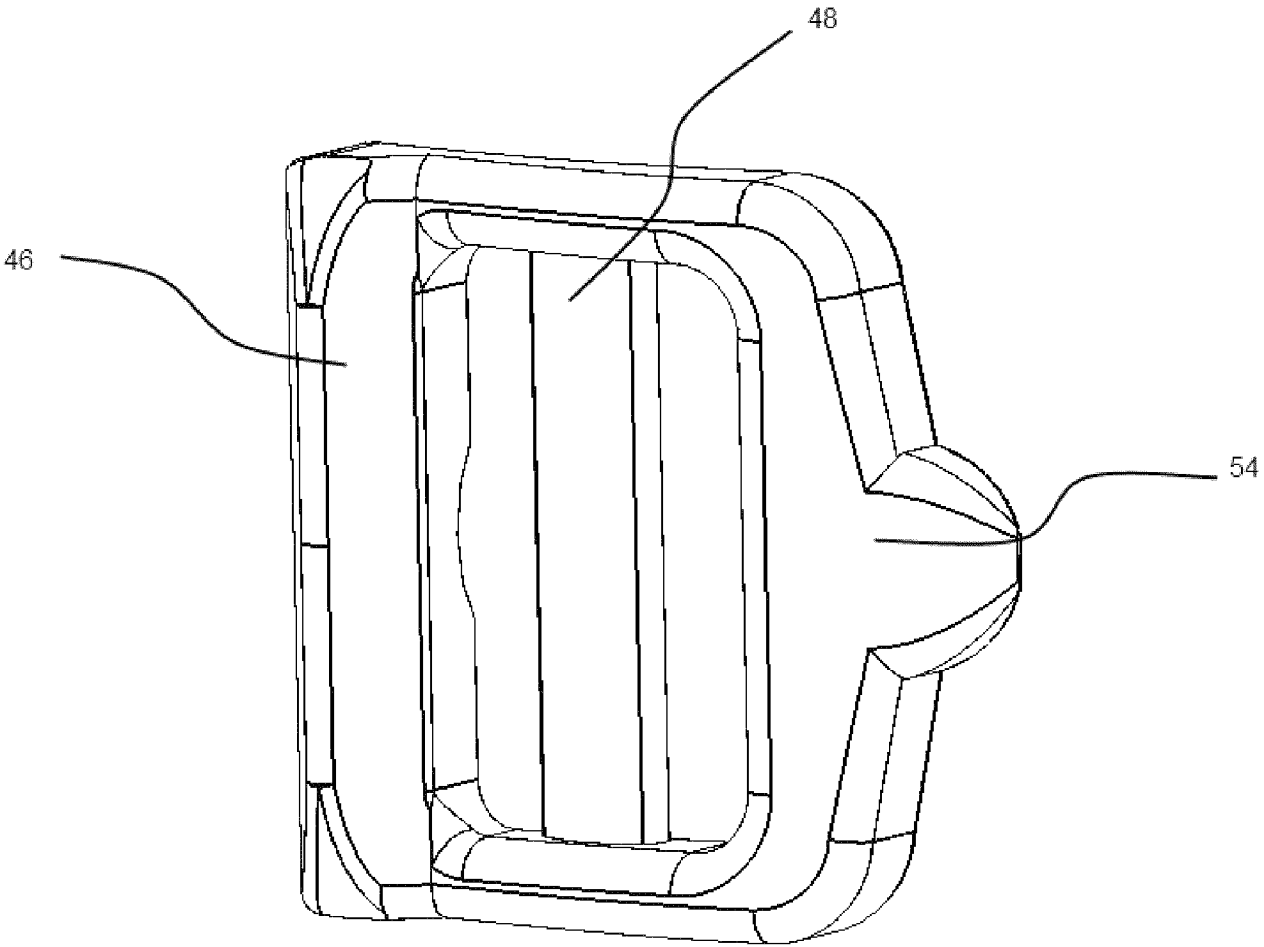
FIG. 2 is a front view of the embodiment of FIG. 1.
Figure 3:
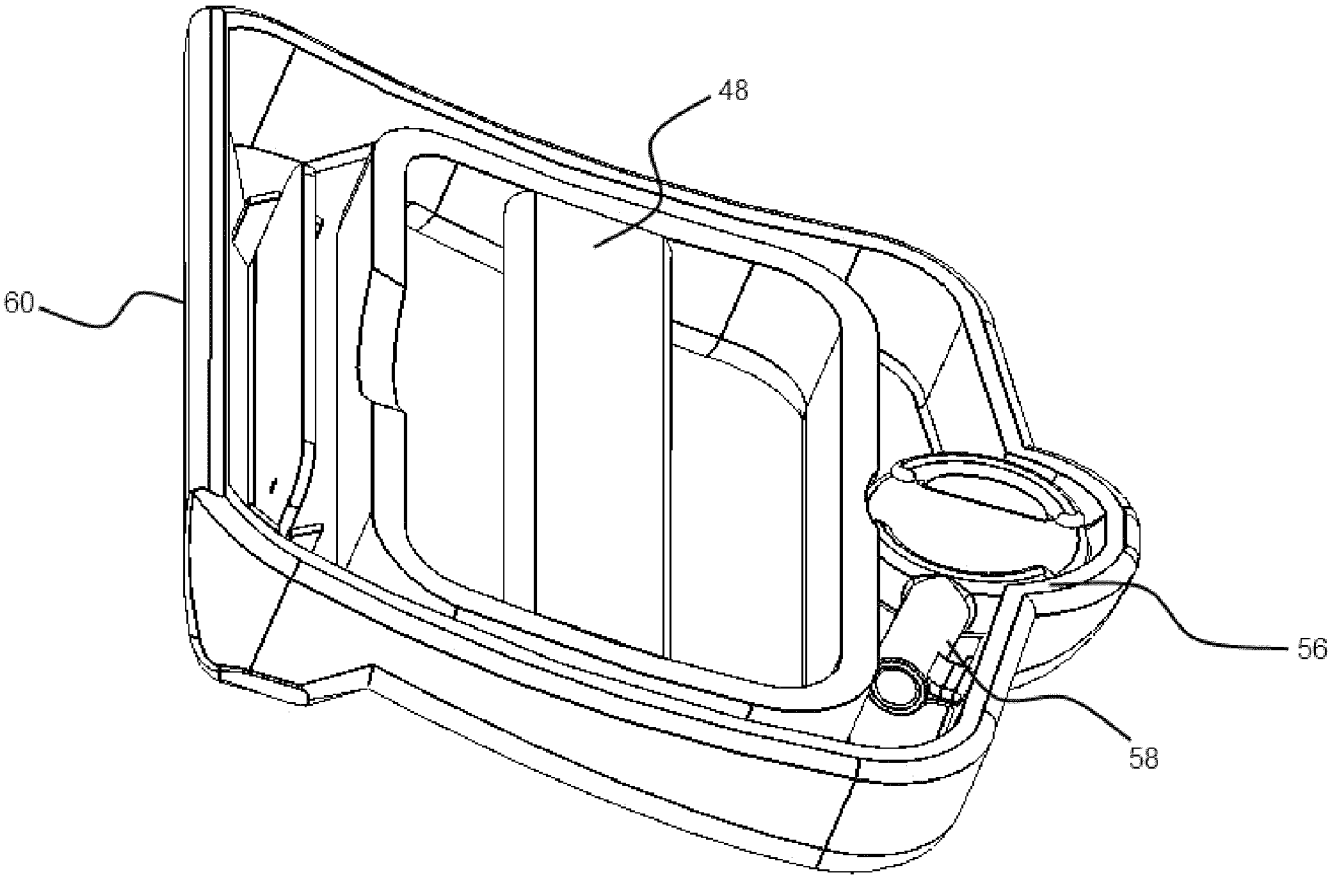
FIG. 3 is another back side perspective view of the embodiment of FIG. 1.
Figure 4:
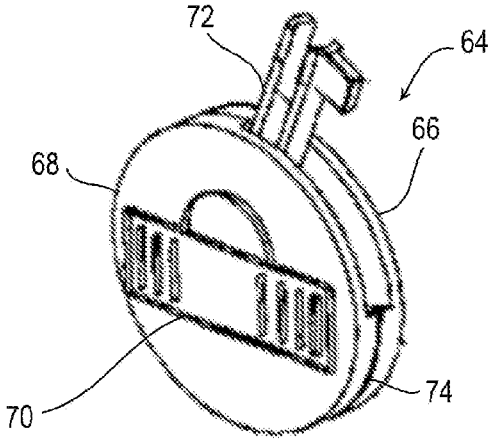
FIG. 4 is a perspective view of one embodiment of a concealed handcuff key as a coin.
Figure 5:
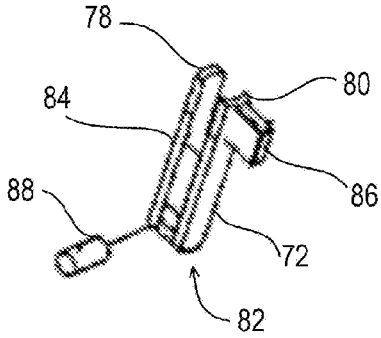
FIG. 5 is a detail view of several components of the embodiment of FIG. 1.
Figure 6:
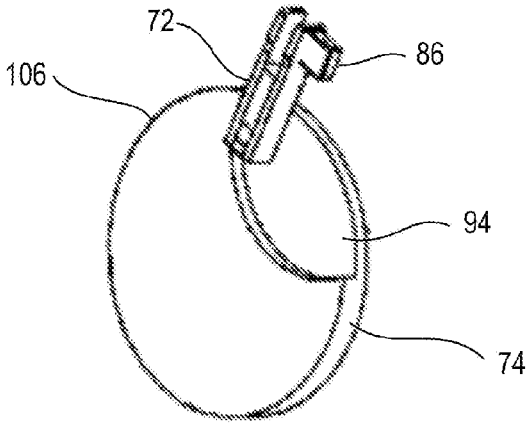
FIG. 6 is a partial cutaway view of the embodiment of FIG. 1.
Figure 7:
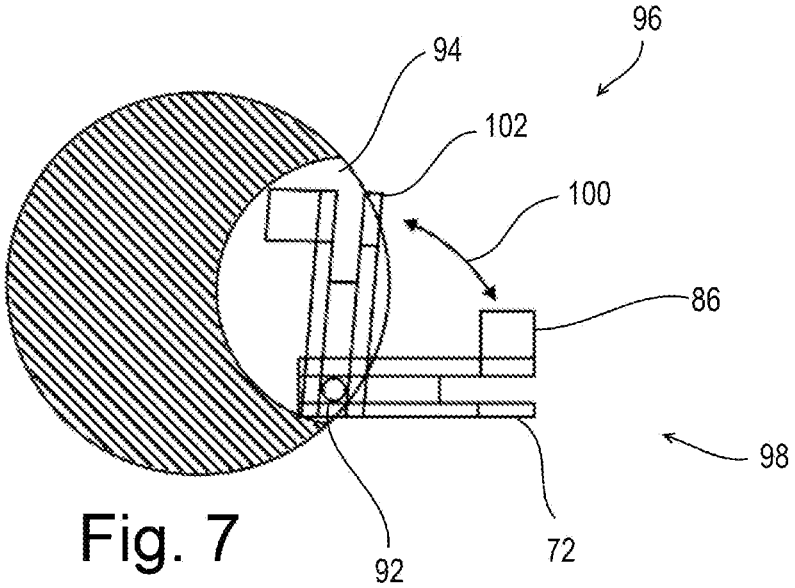
FIG. 7 is a face partial cutaway view of the embodiment of FIG. 1 in an extended position, and in a concealed position.
Figure 8:
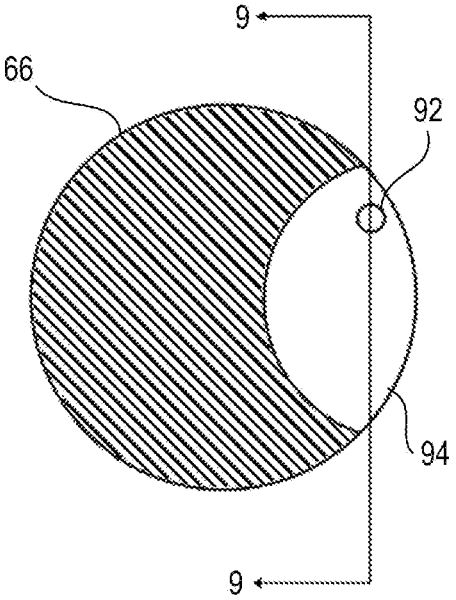
FIG. 8 is a face cutaway view of the embodiment of FIG. 1.
Figure 9:
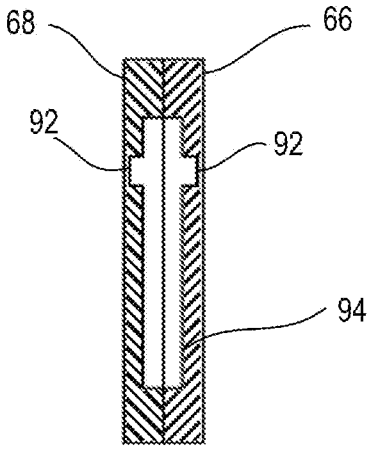
FIG. 9 is a cutaway view taken along line 9-9 of FIG. 8.

To increase functionality of the belt buckle in a situation where the victim must not only release the handcuffs, but then subsequently get away from the malefactor(s) a blade retaining structure and sharpened blade may be provided. To this end, a surface 60 may be provided in the back side of the buckle, for receiving and holding a sharpened blade 62. This surface 60 and one embodiment of the blade 62 are more easily seen in FIG. 2 wherein the blade 62 may be a very simple structure, increasing versatility of the blade and reducing both weight as well as storage size limitations.

FIGS. 4-9 show another embodiment of a concealed handcuff key, in this embodiment, the concealed handcuff key is provided as a coin 64. In most embodiments, the coin 64 comprises a first face side 66, a second face side 68, and a perimeter side 74. While the embodiment shown is a cylinder, other shapes may also be utilized such as polygons. Each of the face sides 66 and 68 may have indicia 70 thereon to be perceived as currency during a cursory investigation. As larger valued coins may be desired by a malefactor, such as dollar or euro coins, it may be desirous to utilize very low currency coins, such as US ¢5 pieces (nickels) which also have the advantage of being relatively thick. The coins may also have a knurled perimeter 74.

Figure 16:
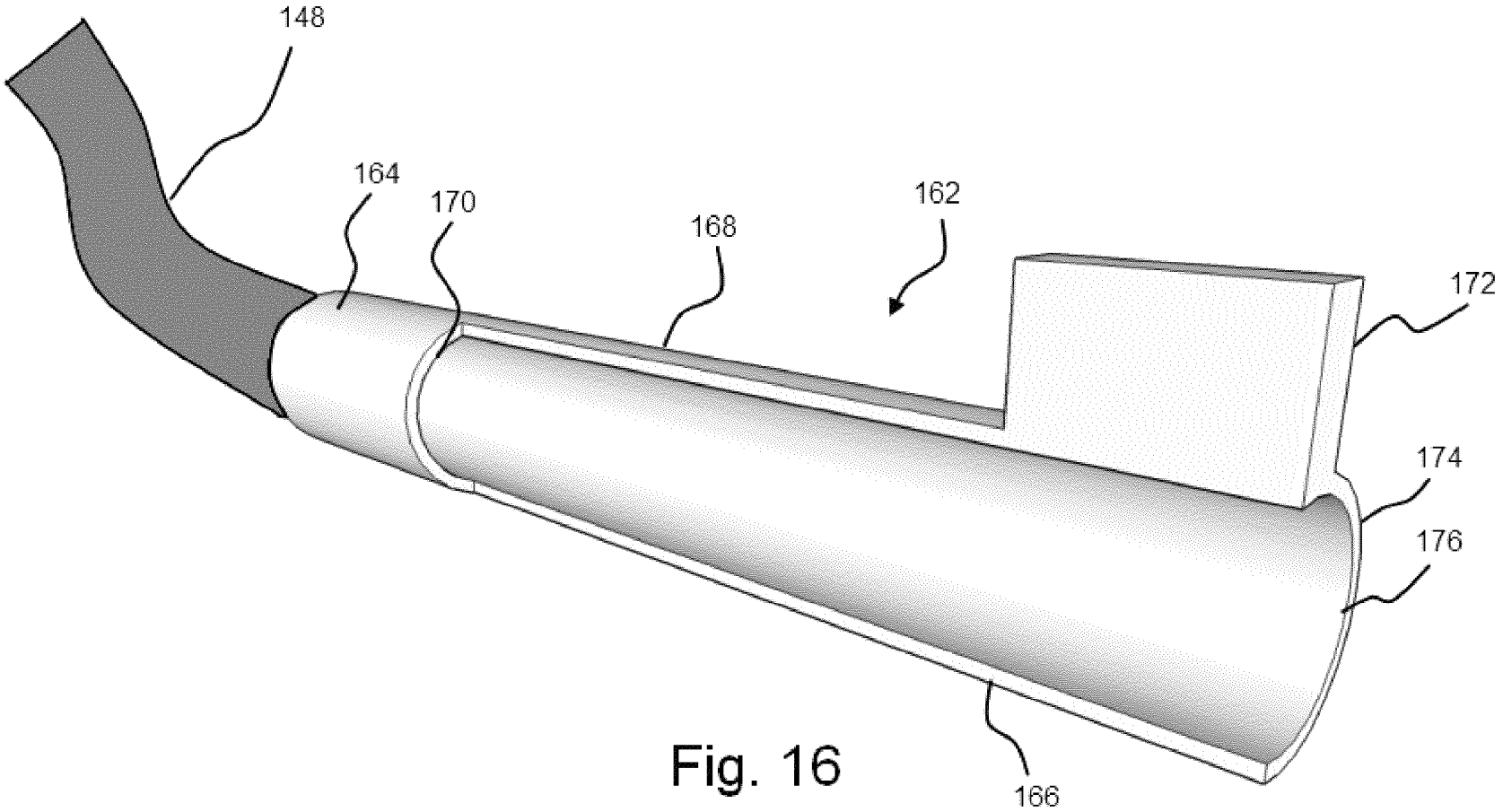
FIG. 16 is a perspective view of another embodiment of a concealed handcuff key provided as a shoelace end.

It has been found that standard handcuff keys such as shown in FIG. 16 often have a cylinder outer diameter 76 which is to large to fit within the coin, thus, an embodiment utilizing an extension 72 is conceived having a first extension 78 and a second extension 80 which in combination have a generally cylindrical outer surface 82, and generally cylindrical inner surface 84. While the cylinder like surfaces are not complete, they do, in combination, function substantially as a cylinder in combination. As with the key of FIG. 1*b*, the second extension has a protrusion 86 extending therefrom to engage the unlocking mechanism of the handcuff.

The extension 72 in one form is pivotably coupled to the coin 64 by way of a pivot pin 88 which passes through a void 90 in the extension 72 and is received within at least one pivot pin receiving surface 92 of one or both sides of the coin 64. A channel 94 is normally provided in the perimeter 74 of the coin 64 so as to receive and hide the extension 72 in a concealed position 96 as shown in FIG. 72. In this concealed position, the key (coin) appear and feels like an ordinary coin to a malefactor not making a through inspection of the device. In one embodiment, a small portion 102 of the extension 86 may project from the perimeter 74 to ease in repositioning the extension 72 in direction of travel 100 to an extended position 98. As such the victim may drag their fingernail around the perimeter, catching the portion 102, and rotating the extension to the extended position 98.

While the channel 94 may be machined in a single body coin blank, the channel 94 may also be machined in a first body 104 and/or second body 106, each forming a portion (half) of the overall device. The portions are then adhered, welded, or otherwise attached to each other, retaining the extension 86 and pin 88. This arrangement also facilitates machining of the pin receiving surfaces 92 while not marring or deforming either face side 66 or 68.

Figure 10:
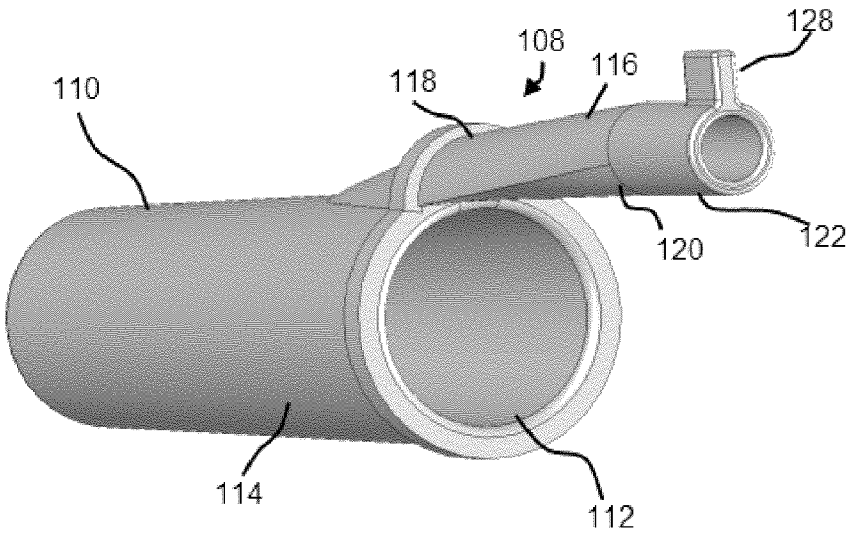
FIG. 10 is a perspective view of one embodiment of a concealed handcuff key provided as a removable pen cap.
Figure 11:
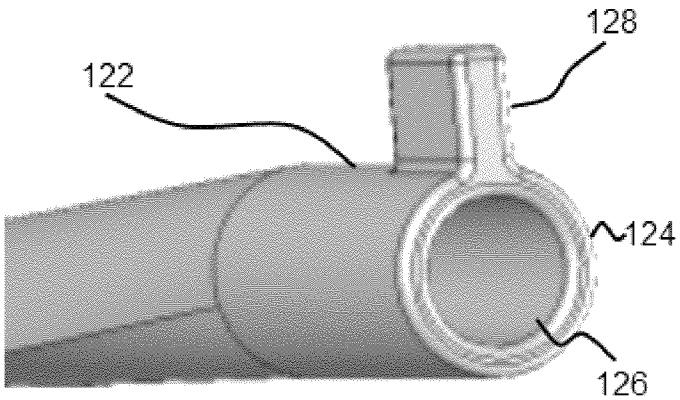
FIG. 11 is a detail view of the embodiment of FIG. 10.

Looking to FIGS. 10 and 11, a concealed handcuff key 108 is shown as a common pen cap 110. The pen cap 110 has an outer surface 114, and an inner surface 112 which may be cylindrical, or slightly frusta-conic so as to frictionally engage the writing end of a pen. The pen cap 110 also comprises a pocket clip 116 which c. the pocket clip having a first end 118 at the pen cap, and a second end 120 terminating in a cylinder 122 having an outer diameter 124 smaller than the inner diameter of a handcuff keyway 38, and an inner diameter 126 larger than the outer diameter of a handcuff keyway pin 40; and a protrusion 128 extending from the outer diameter of the cylinder which actuates an unlocking mechanism 36 of a handcuff. The pen cap 110 may simulate a common "disposable" style pen cap, and thus may go unnoticed by the malefactor(s) as an undesirable and inconsequential device (pen).

Figure 17:
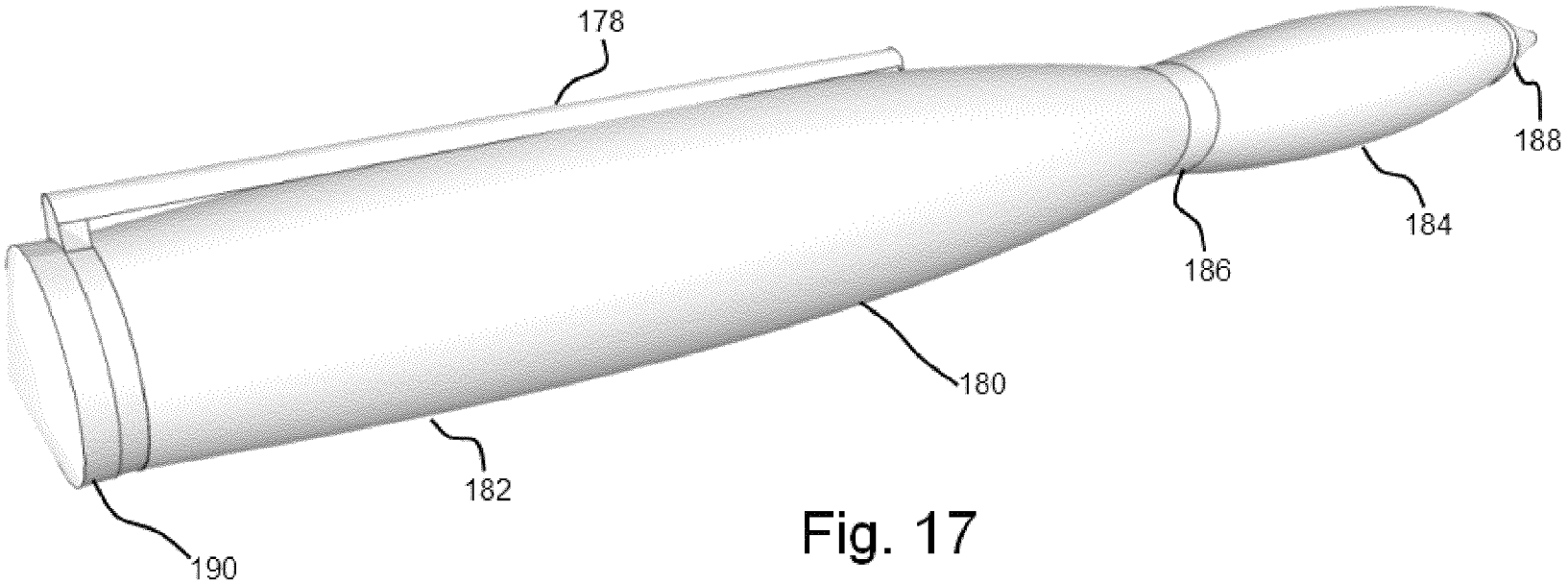
FIG. 17 is a perspective view of another embodiment of a concealed handcuff key provided as a pen clip.
Figure 18:
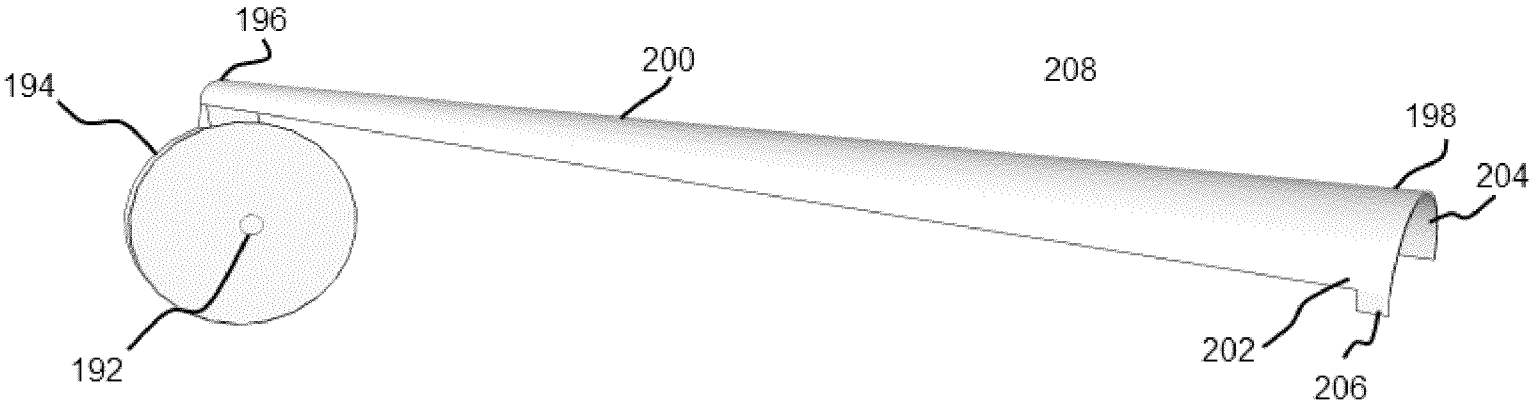
FIG. 18 is a detail view of one component of the embodiment of FIG. 17.

Another similar device is shown in FIGS. 17 and 18 where a pen clip 178 is (removably) attached to a pen 180. Such pens are common to pen makers in the fields of craft woodworkers and other collectors who desire a more aesthetically pleasing pen than common "disposable" pens. In one form, these pens comprise an upper barrel 182 and lower barrel 184 which may be separated by a ring 186. Pens having a single barrel, or omitting the ring 186 are also common. Each pen normally terminates on one end with a point 188 from which the ink cartridge extends. The opposing end of the pen often terminates in a clip retainer 190 which often has a threaded stud connecting the clip retainer to the upper barrel 182 and holding the clip 178 by passing through a surface defining a void there through. In some forms, the clip retainer 190 is a unitary structure with the clip 178. The clip 178 generally has a pen attachment portion 194 and a pocket extension 208 extending therefrom. The pocket extension 208 has a proximal end 196 adjacent the pen attachment portion 194 and a distal end 198, with an intermediate portion 200 there between. Commonly, the pocket extension 208 is unitary with the pen attachment portion. The distal end 198 in one form has a substantially cylindrical outer surface 202, a substantially cylindrical inner surface 204, and a tangential protrusion 206 which function together as a handcuff key.

While the clip 178 shown has a distal end 198 which forms a semi-cylinder, a full cylinder may also be used. In this embodiment, the protrusion 206 may extend radially therefrom, rather than the tangential version shown.

Figure 1B:
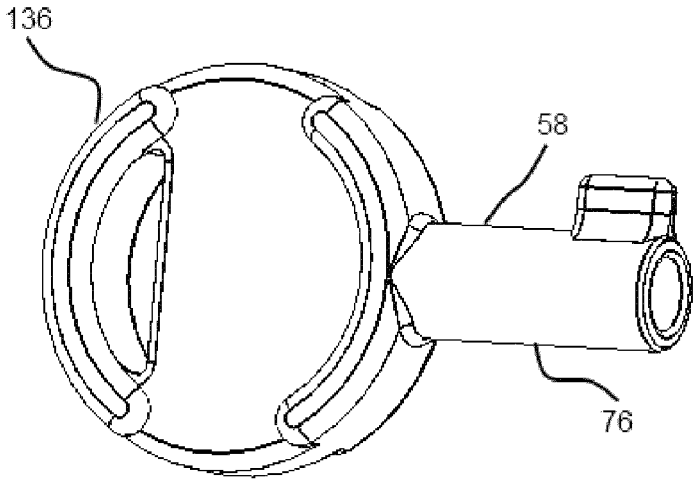
Fig. 1b Prior Art
FIG. 1*b* is a perspective view of a prior art handcuff key.
Figure 12A:
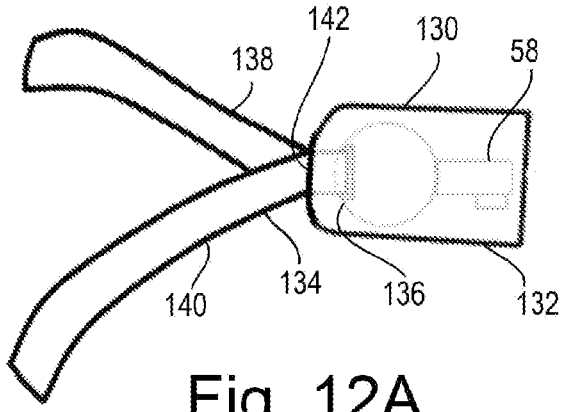
FIG. 12A is a hidden line view of one embodiment of a concealed handcuff key provided as a zipper pull.
Figure 12:
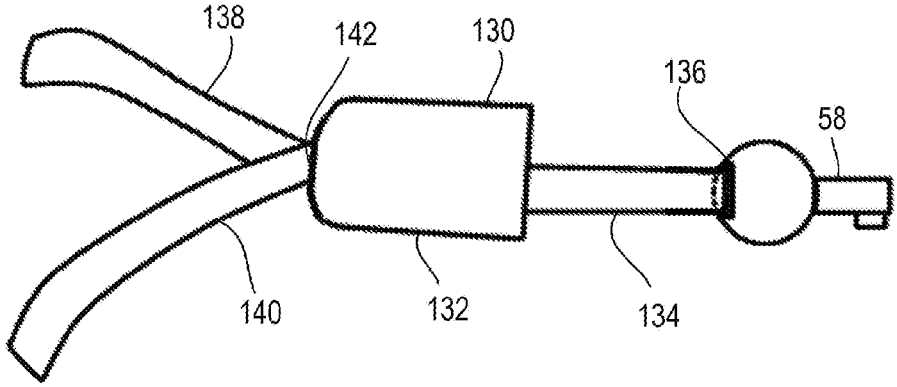
FIG. 12 is a face view of one embodiment of a concealed handcuff key provided as a zipper pull.
Figure 13:
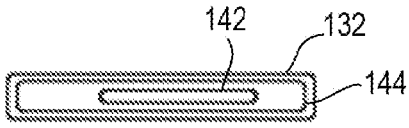
FIG. 13 is an end view of one embodiment of a component of FIG. 12.

Another embodiment is shown in FIGS. 12 and 13 which simulates a zipper pull 130. In this embodiment a handcuff key 58 such as that shown in FIG. 1*b* is used along with a housing 132 which may be a malleable plastic or plastic-like material which allows passage of a cord 134 and key 58. In one form, both ends 138 and 140 extend from a surface defining a cord void 142 to form a loop through the cord engaging end 136 of the key 58. On the opposite end of the housing 132 in one embodiment is a surface defining a key void 144 which allows passage of the key 58 into the housing 132 where it is hidden from view. In one form, the inner surface of the housing 132 is smaller than the outer surface of the key 58 and thus deforms outward and holds the key in place. The housing 132 and cord 134 are similar to pieces commonly used as zipper pulls, and will hopefully go unnoticed by a malefactor during a normal search.

Figure 15:
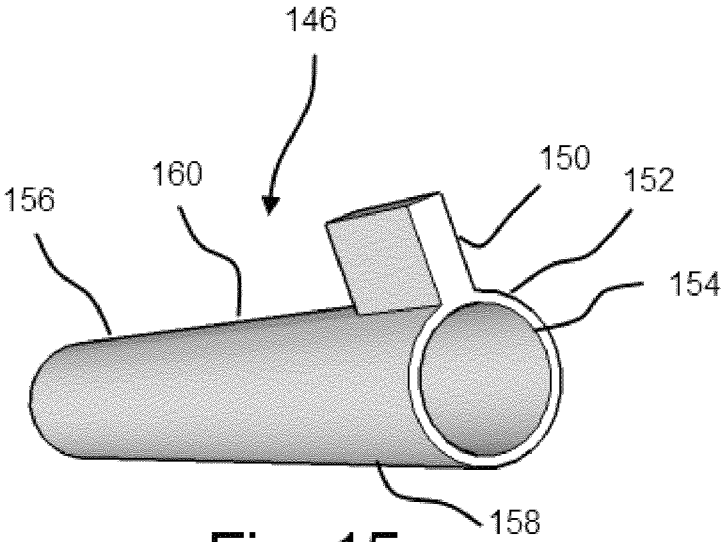
FIG. 15 is a perspective view of one embodiment of a concealed handcuff key provided as a shoelace end.

Yet another embodiment is shown in FIGS. 15 and 16 where a concealed handcuff key is provided as a lace or lace end 146. The lace end 146 may be crimped, adhered, or otherwise attached to a lace 148 such as a shoelace, or bootlace. As such laces often have hard plastic or metal ends, the only portion of the lace end 146 which may be noticed by a malefactor is the flag or protrusion 150 which extends from the outer diameter 152 of the lace end 146, and the inner diameter 154 will be insignificant to the malefactor, but as described above, engages the pin 40 of the handcuff keys. The lace end 146 generally comprises a lace attachment end 156 which is attached to one or both ends of the lace 148, and a second end 158 with the protrusion 150 extending therefrom, and a median portion 160 therebetween. If only one end of the lace 148 has a lace end 146 with a protrusion 150, the opposite end of the lace 148 may be visually identical, without the protrusion 150 to ease in attaching "lacing" the shoe or boot with the lace 148. The lace end 146 may also be provided as a separate element which may then be attached to the lace 148 subsequent to lacing the shoe or boot.

FIG. 16 also shows a specific embodiment 162 where which may be bent from a flat piece of material, and generally comprises a first end 164 which is attached to the lace 148, and a second end 166 having a protrusion 172, with an intermediate portion 168 there between. The outer diameter 174, and inner diameter 176 of the second end 166 functions as described above although they may not be complete cylindrical surfaces, testing of similar shapes for handcuff keys have shown to be sufficiently effective. In one form, the first end 164 terminates in a surface 170 which transitions from the lace attachment portion to the handcuff opening (key) portion.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A handcuff key which is concealed as an everyday item which will normally be overlooked by an opponent during a customary search; the apparatus provided as an assembly concealed as a zipper pull, the concealed handcuff key assembly comprising:

a. a lock engagement end and a cord engaging end provided on the handcuff key;

b. a malleable cord removably attached to the cord engaging end of the handcuff key;

c. a housing having:

i. an opaque outer surface;

ii. a surface defining a cord void through which the cord passes such that the housing remains attached to the cord while the key is;

iii. a surface defining a key void through which the key passes; and d. wherein the housing completely surrounds the key and selectively conceals the entire handcuff key from identification.

2. The handcuff key assembly as recited in claim 1 wherein the cord is a flat strap.

3. The handcuff key assembly as recited in claim 1 wherein the housing is malleable.

4. The handcuff key as recited in claim as recited in claim 3 where in a relaxed state, the housing is smaller in diameter than the diameter of the handcuff key and wherein the diameter of the housing deforms outward to hold the handcuff key in place.

5. The handcuff key assembly as recited in claim 1 wherein the cord passes twice through the cord void, and once through the cord engaging end of the key, so as to form a loop through the cord engaging end of the key such that both ends of the cord are positioned external of the housing.

6. The handcuff key as recited in claim 1, wherein the key extension comprises:

a. a first semi-cylindrical extension;

b. a second semi-cylindrical extension; and c. a protrusion extending from the second semi-cylindrical extension of the cylinder which actuates an unlocking mechanism of a handcuff.

7. A handcuff which is concealed as an everyday item which will normally be overlooked by an opponent during a customary search, the concealed handcuff key assembly comprising:

a) a lock engagement end and a cord engaging end provided on the handcuff key;

b) a malleable cord removably attached to the cord engaging end of the handcuff key;

c) a malleable housing comprising:

i. an opaque outer surface;

ii. a surface defining a cord void through which the cord passes;

iii. a surface defining a key void through which the key passes;

iv. wherein the housing surrounds the entire key and selectively conceals the entire handcuff key from identification; and v. where in a relaxed state, the housing is smaller in diameter than the diameter of the handcuff key and wherein the diameter of the housing deforms outward to hold the handcuff key in place.

8. The handcuff key assembly as recited in claim 7 wherein the cord passes twice through the cord void, and once through the cord engaging end of the key, so as to form a loop through the cord engaging end of the key such that both ends of the cord are positioned external of the housing.

9. A handcuff key which is concealed as an everyday item which will normally be overlooked by an opponent during a customary search, the concealed handcuff key assembly comprising:

d) a lock engagement end and a cord engaging end provided on the handcuff key;

e) a malleable housing comprising:

vi. an opaque outer surface;

vii. a surface defining a cord void through which a cord passes when the cord is utilized;

viii. a surface defining a key void through which the key passes;

ix. wherein the housing surrounds the key and selectively conceals the handcuff key from viewing; and x. where in a relaxed state, the housing is smaller in diameter than the diameter of the handcuff key and wherein the diameter of the housing deforms outward to hold the handcuff key in place.

* * * * *